United States Patent [19]

Palumbo

[11] Patent Number: 4,697,288

[45] Date of Patent: Oct. 6, 1987

[54] CONVERTIBLE GARMENT

[76] Inventor: Angeline Palumbo, 27703 Ortega Hwy., No. 96, San Juan Capistrano, Calif. 92675

[21] Appl. No.: 848,773

[22] Filed: Apr. 7, 1986

[51] Int. Cl.[4] ..... A41D 27/10; A41D 17/02

[52] U.S. Cl. ..... 2/269 R; 2/243 R

[58] Field of Search ..... 2/105, 269 R, 74, 76, 2/243 R

[56] References Cited

U.S. PATENT DOCUMENTS 2,441,274 5/1948 Kay ..... 2/76

2,893,015 7/1959 Fox ..... 2/269

3,111,681 11/1963 Nelson ..... 2/74

3,170,167 2/1965 Isaacs ..... 2/269

3,665,516 5/1972 Orovan ..... 2/269

*Primary Examiner*—Doris L. Troutman

*Attorney, Agent, or Firm*—Stetina and Brunda

[57] ABSTRACT

A convertible garment is disclosed characterized by use of an extensible waistband region which is extensible between a first compacted position and a second expanded position which selectively modifies the overall length of the garment to accomodate growth in the user or usage for differing event styles of dress.

8 Claims, 8 Drawing Figures

Fig. 1
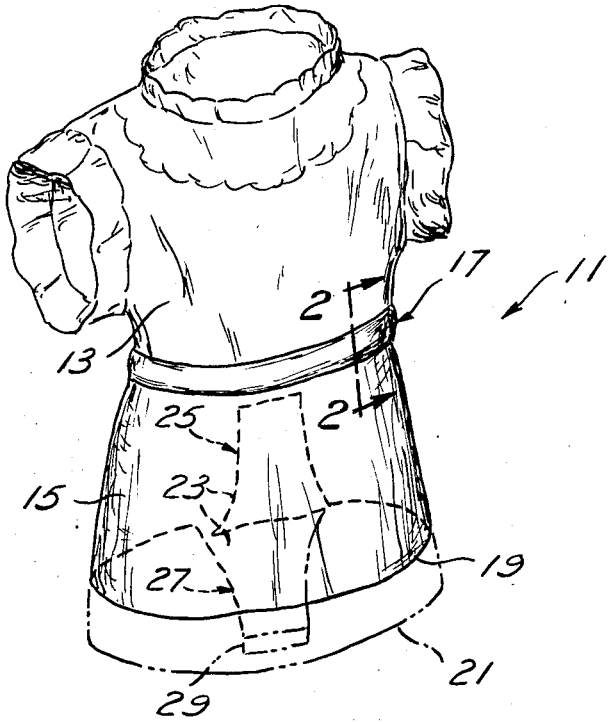
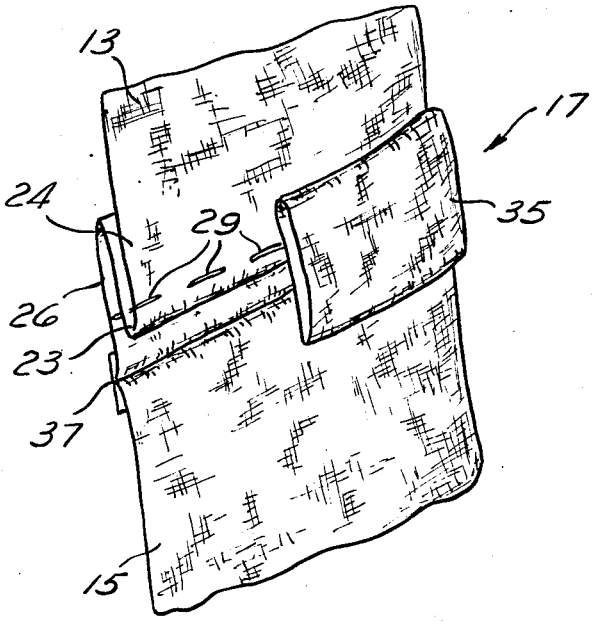
Fig. 2
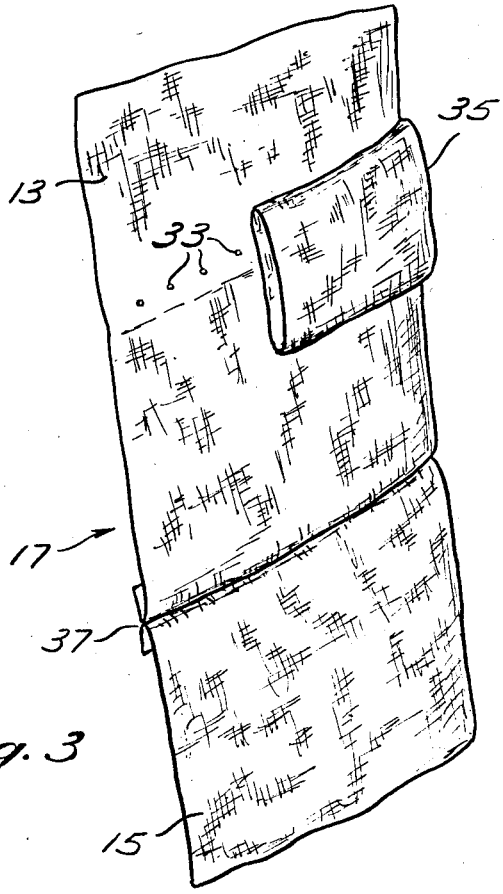
Fig. 3

Fig. 4
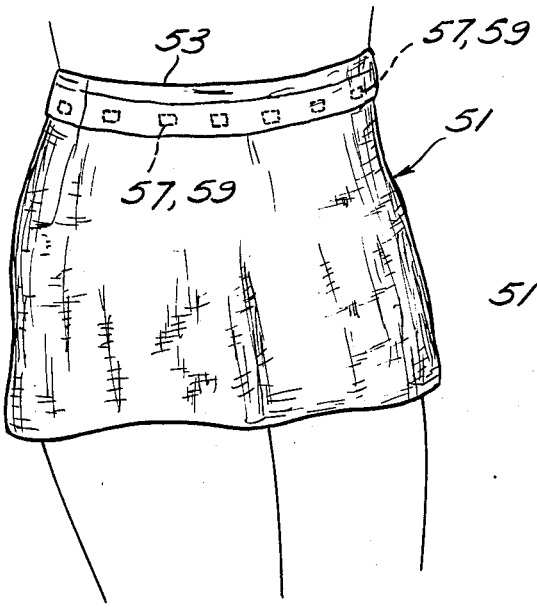
Fig. 5
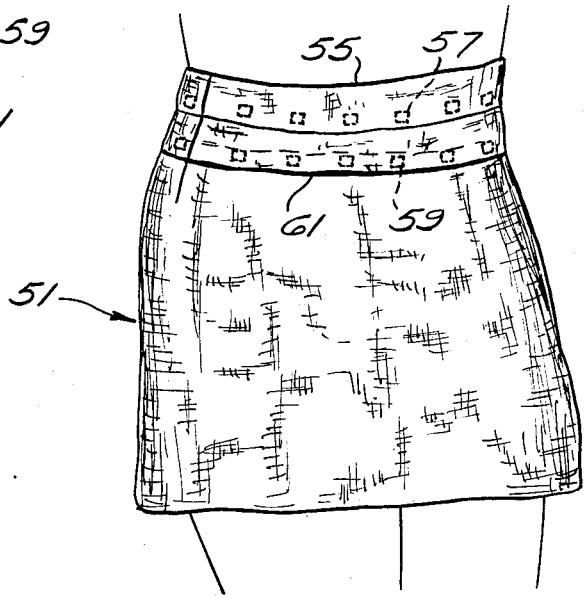
Fig. 6
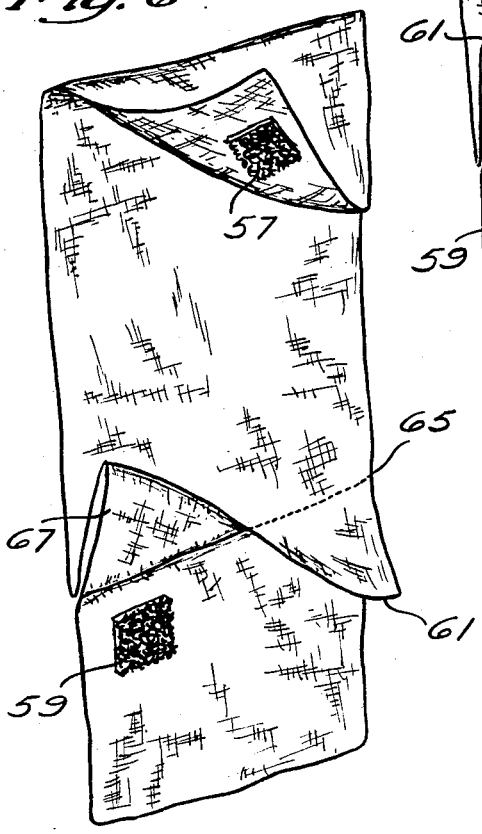
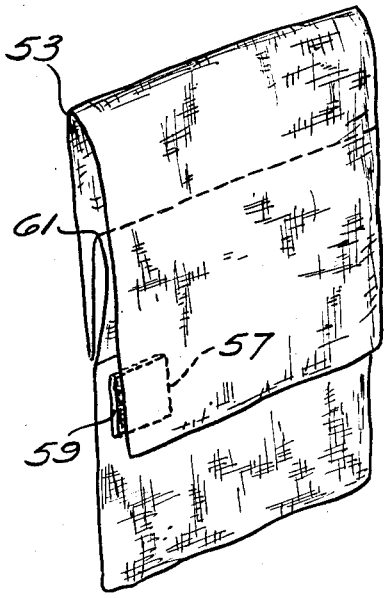
Fig. 7
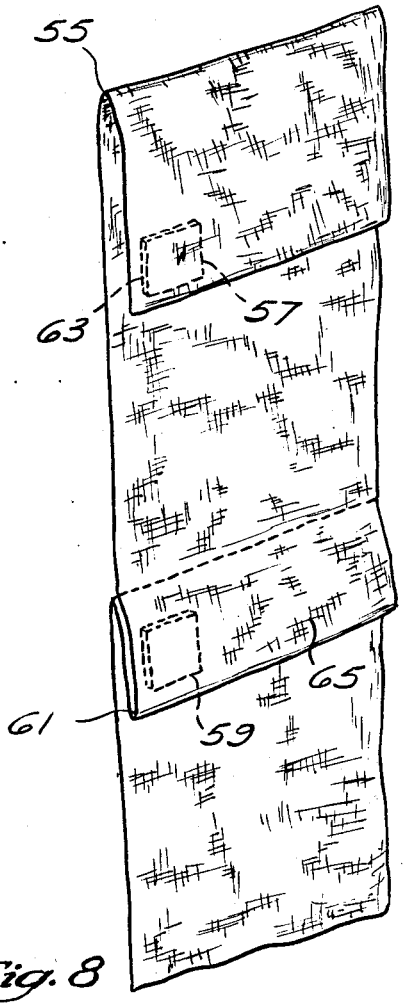
Fig. 8

CONVERTIBLE GARMENT

BACKGROUND OF THE INVENTION

This garment relates to wearing apparel and more particularly to feminine garments such as dresses and shirts that can be converted from one length to another.

Various proposals have been made regarding garments capable of being converted from one form to another, as evidenced in U.S. Pat. No. 1,418,281, U.S. Pat. No. 1,470,849 and U.S. Pat. No. 1,629,561. U.S. Pat. No. 4,106,125, having common inventorship with the present invention, discloses a garment that includes gathering means and drawstrings that cooperate with a concealed crotch panel to provide a skirt that may conveniently be converted into pants or shorts without the necessity of removing the garment. However, none of the above-referenced structures disclose or suggest garments such as skirts or dresses that may be lengthened to allow the same garment to be worn at various lengths.

The present invention allows the wearer to make the garment change lengths to accommodate growth in children, or a desire to wear a different length garment in different settings. Though the usefulness of the present invention in relation to the growth of children is believed to be readily apparent, it is anticipated that the present invention may have equally significant application where the wearer wishes to use the garment for different events, where different lengths are more appropriately worn at each event. For example, the present invention provides a skirt that may be worn as a tennis skirt and may be lengthened to a miniskirt, or longer. As set forth below, it is anticipated that the present invention may have application in a variety of situations wherein convertible length is desirable.

SUMMARY OF THE INVENTION

Garments are disclosed that are convertible in length about the waistband region of the same. In one embodiment the garment includes a first fold formed in the garment material with stitching holding the fold in place and the waistband adapted to substantially overlap the stitching. Upon removal of the stitching, the lower fold portion may be extended downwardly to increase the length of the garment. In another embodiment, the garment includes engageable, releaseable attachment members which, when engaged, define a fold that effectively shortens the length of the garment. An additional fold is provided to conceal the lower attachment member when the releaseable attachment members are not engaged. When the attachment members are engaged, those members are also concealed.

BRIEF DESCRIPTION OF THE DRAWINGS

FIG. 1 is a perspective view of a convertible garment in accordance with the present invention in the configuration of a dress.

FIG. 2 is a sectional view taken along section line 2—2 of FIG. 1.

FIG. 3 is a fragmentary sectional view similar to FIG. 2 illustrating elongation of the garment.

FIG. 4 is a perspective view of another convertible garment in accordance with the present invention in the configuration of a skirt.

FIG. 5 is a perspective view of the skirt shown in FIG. 4 in the elongated configuration.

FIG. 6, 7 and 8 are fragmentary sectional views of the garment illustrated at FIGS. 4 and 5, further illustrating elongation of the garment.

DETAILED DESCRIPTION OF THE PRESENTLY PREFERRED EMBODIMENT

FIG. 1 is a perspective view of one embodiment of the invention wherein the length of the garment is convertible about the waistband. Dress 11 includes an upper, or blouse portion 13 and a lower, or skirt portion 15. Portions 13 and 15 meet or are joined together at waist region 17, illustrated in more detail at FIGS. 2 and 3. As explained below, waist region 17 is extendable such that the length of dress 1 may be varied between level 19 and level 21. Dress 11 further includes flap 23 that may be disposed in positions 25 or 27. Flap 23 permits the skirt portion 15 of dress 11 to be utilized as a skirt, when flap 23 is in position 25, against the rear of the dress, or as a jumpsuit when the flap 23 is in position 27 and bridges the front and rear portions of the dress. Flap 23 typically includes a releasable attachment member 29 to facilitate a disposition of flap 23 in either position 25 or 27. A more detailed disclosure of the flap 23 and it's intended use is disclosed in U.S. Pat. No. 4,106,125 issued to the subject applicant, the disclosure of which is specifically incorporated herein by reference.

FIGS. 2 and 3 represent fragmentary sectional views of the garment 11 illustrated at FIG. 1, showing the waistband region in more detail. In FIG. 2 the waistband region is shown in the normal or contracted position. In FIG. 3 the waistband region 17 is disposed in the elongated position.

Referencing FIG. 2, waistband region 17 comprises a first lengthwise fold 23, which extends substantially about the waistband region. The fold 23 defines an upper fold portion 24 and a lower fold portion 26. Removeable stitches 29 are disposed lengthwise substantially about the waistband region, and are adapted to hold the fold 23 in place. Upon removal of stitches 29, the waistband region 17 is extendable to the position illustrated at FIG. 3. Stitch holes 33 may, depending upon the size of the holes, be generally unnoticeable. Belt 35 is preferably connected to upper fold portion 25 and permits concealment of stitches 29, when the waistband region 17 is in the contracted position, and conceals stitch holes 33, when waistband region 17 is in the elongated position. Hemline 37 joins upper dress portion 13 and lower dress portion 15. The spacial relationship between hemline 37 and belt 35, shown at FIGS. 2 and 3, illustrate the elongation of the waistband region 17 that may be affected in accordance with the present invention. If desired, hemline 37 may be disposed such that it is normally concealed when the waistband region 17 is in the contracted position, as illustrated at FIG. 2 or at a variety of other locations.

FIGS. 4 and 5 are perspective views of an additional embodiment of the invention wherein the garment is formed as a skirt. Skirt 51 is illustrated in FIG. 4 in the normal, or contracted position. In FIG. 5, skirt 51 is illustrated in the elongated or extended position. As with the dress illustrated at FIGS. 1, 2 and 3, the skirt 51 may, but not necessarily include flap 23 and lengthens by extension about the waistband region. When the skirt 51 is in the normal or contracted position, the upper portion of the skirt is formed to fold 53 with releasable attachment members 57 and 59 being connected. In the extended position, fold 53 is unformed and fold 55 is formed such that releasable attachment members 57 and 59 are no longer joined. In practice, releasable attachment members 57 and 59 may be formed of snaps, hooks, hook and loop fabric, or the like.

Fold 61 may be provided to conceal releasable attachment members 59 when the skirt is in the extended position. Fold 61 defines an upper fold portion 65 and a lower fold portion 67. Fold 61 is readily displaceable, as shown at FIGS. 6 and 7, to permit releasable attachment members 57 and 59 to be joined, thus disposing the skirt in the normal or contracted position.

As shown at FIG. 8, the garment may also be provided with additional releasable attachment members 63 formed on the outer surface of the skirt 51 intermediate the fold 55 and fold 61. Releasable attachment members 63 may be adapted to join releasable attachment members 57 when the skirt 51 is in the elongated position. Either fold 53 or folds 55 may receive a belt if the wearer desires to use one.

It is also anticipated that the attachment members may be formed or additional attachment members may be added such that the length of the garment may be variably adjusted to more than two lengths. The attachment members may be formed to secure to the texture of the garment, to the garment material itself, the attachment members may be formed to have vertical dimensions that accomodate variable lengths or additional attachments members may be added to the garment at spaced vertical positions.

From the foregoing, it may be seen that the garment of the present invention may be easily converted in length by expansion or contraction of the waistband region, thus rendering the garment highly versatile and adaptable to a variety of requirements. These and other modifications and variations of the invention wherein the garment is expandable about the waistband region are intended to be within the scope of the invention, as understood by one of ordinary skill in the art.

What is claimed is:

1. A garment formed of material which presents both its upper and lower portions to the exterior of the garment and convertible in length comprising:

a first fold formed intermediary in the material between its upper and lower portions, said fold comprising an upper fold portion and a lower fold portion;

removable stiches holding said fold in place, said stiches being removable to allow said lower fold portion to extend downwardly to thereby increase the length of the garment; and a waistband connected to the material at said upper fold portion by said removable stiches said waistband substantially overlapping and concealing said removable stiches.

2. The garment as recited in claim 1 wherein said upper and lower fold portions are substantially bounded by said stitches.

3. The garment as recited in claim 1 wherein said garment is formed as a dress.

4. A garment having an outer surface made of material and convertible in length between a first and second length comprising:

a material having an upper margin;

a first releasable attachment member disposed along the outer surface of the material spaced from said margin;

a second releasable attachment member disposed along the outer surface of the material intermediate said first releasable attachment member and said upper margin said first and second attachment members being engageable;

a first fold in the material between said first and second attachment members, said first fold defining a first fold portion overlapping said first releasable attachment member, said first fold portion being readily displacable to facilitate contact between said first and second releasable attachment members; and a second fold formed in the material intermediate said first fold and said second releasable attachment member, said second fold defining a second fold portion concealing said first and second releasable attachment members when said first and second releasable members are engaged.

5. The garment as recited in claim 4 wherein the garment is a skirt.

6. The garment as recited in claim 4 wherein said first releasable attachment members are spaced approximately four inches from said margin.

7. The garment as recited in claim 1 further comprising a third releasable attachment member disposed along the outer surface of the material intermediate said first and second folds, said third releasable attachment member being engageable with said second releasable attachment member.

8. The garment as recited in claim 1 wherein said second fold is adapted to receive a waistband.

* * * * *